United States Patent [19]

Schuettenberg et al.

[11] Patent Number: 4,606,833

[45] Date of Patent: Aug. 19, 1986

[54] MIXTURE OF DITHIODIGLYCOL AND POLYOXYALKYLENE GLYCOL DERIVATIVES AS A LUBRICATING ADDITIVE

[75] Inventors: Alexander Schuettenberg; Merlin R. Lindstrom; Benedict R. Bonazza, all of Bartlesville, Okla.

[73] Assignee: Phillips Petroleum Company, Bartlesville, Okla.

[21] Appl. No.: 664,461

[22] Filed: Oct. 25, 1984

[51] Int. Cl.[4] ..... C10M 141/02; C10M 141/08

[52] U.S. Cl. ..... 252/49.3; 252/52 A; 252/48.2; 252/32.5; 252/45

[58] Field of Search ..... 252/49.3, 52 A, 45, 252/48.2, 32.5

[56] References Cited

U.S. PATENT DOCUMENTS

| | | | |
|---|---|---|---|
| 4,250,046 | 2/1981 | Przybylinski | 252/49.3 |
| 4,317,740 | 3/1982 | Eisenhard | 252/49.3 |
| 4,384,965 | 5/1983 | Hellsten et al. | 252/49.3 |

*Primary Examiner*—Jacqueline V. Howard

*Attorney, Agent, or Firm*—French and Doescher

[57] ABSTRACT

A mixture of di-(2-hydroxyethyl)disulfide and a derivative of polyoxyalkylene glycol selected from the group consisting of polyoxyalkylene glycol esters and polyoxyalkylene glycol ethers. The mixture is useful in improving the lubricating characteristics of water based fluids in metal working operations.

38 Claims, No Drawings

MIXTURE OF DITHIODIGLYCOL AND POLYOXYALKYLENE GLYCOL DERIVATIVES AS A LUBRICATING ADDITIVE

This invention relates to a mixture which is useful as a lubricating additive for water-based fluids used in metalworking operations.

In machining operations of metals, such as cutting, drilling, drawing, tapping, polishing, grinding, turning, milling and the like, it is customary to flood the tool and the work with a coolant for the purpose of carrying off heat which is produced during the operation. Such coolants are typically water-based or are based on liquid organic compounds.

It is also customary to employ these coolants in combination with various agents having lubricating properties for reducing friction between the tool and the work piece. A number of lubricating additives are known. Some of these additives are soluble in water and are thus suitable for use in water-based fluids used in metalworking operations. However, it is always desirable to develop new lubricating additives for water-based fluids used in metalworking operations.

In accordance with the present invention, there is provided a mixture of di-(2-hydroxyethyl)disulfide (also called diethanol disulfide or dithiodiglycol) and a derivative of polyoxyalkylene glycol selected from the group consisting of polyoxyalkylene glycol esters and polyoxyalkylene glycol ethers. When the mixture is added to water-based fluids used in metalworking operations, the lubricating characteristics of such fluids are improved.

Other objects and advantages of the invention will be apparent from the foregoing brief description of the invention and the detailed description of the invention which follows as well as the claims.

Any suitable polyoxyalkylene glycol ester may be utilized in the lubricating additive of the present invention. Preferred polyoxyalkylene glycol esters are (a) esters of a polyoxyalkylene glycol or a monoether thereof and a phosphorus containing acid and (b) esters of polyoxyalkylene glycol or a monoether thereof and a carboxylic acid. Of the phosphorus containing acids, phosphoric acid is preferred. Of the carboxylic acids, aliphatic carboxylic acids are preferred.

A generic formula for a suitable ester of polyoxyalkylene glycol or a monoether thereof and a phosphorus containing acid follows:

$$[R'-O-(RO)_n]_m-\overset{\overset{O}{\|}}{\underset{\underset{[OH]_q}{|}}{P}}-[(OR)_{n'}-O-R'']_r$$

wherein

- R = the ethylene ($-C_2H_4-$) group or the propylene ($-C_3H_6-$) group;
- n = 2 to 30 (preferably 3 to 12);
- n' = 2 to 30 (preferably 3 to 12), n and n' are independent of each other;
- m = 1 to 3;
- q = 0 to 2;
- r = 3 − (m + q), wherein m + q + r must equal 3; and
- R' and R'' are independently selected from H, a straight chain or branched alkyl group, cycloalkyl group, aryl group or alkaryl group having from 3 to 30 carbon atoms (preferably 4 to 18 carbon atoms). It is presently preferred that at least one of R' and R'' is selected from such alkyl, cycloalkyl, aryl or alkaryl group.

Examples of suitable esters of polyoxyalkylene glycol or a monoether thereof and a phosphorous containing acid include those disclosed in U.S. Pat. No. 3,005,056, such as the monohydrogen phosphate ester derived from an equimolar mixture of nonylphenol polyoxyethylene (12) ether and polyoxyethylene (9) glycol; the dihydrogen phosphate ester derived from lauryl alcohol polyoxyethylene (4) ether; the tertiary phosphate ester derived from lauryl alcohol polyoxyethylene (23) ether; the dihydrogen phosphate ester derived from nonylphenol polyoxyethylene (2) ether; and the monohydrogen phosphate ester derived from hexyl alcohol polyoxyethylene (8) ether (1 part) followed by reaction with 9 parts ethylene oxide. A preferred ester is a mixture of mono- and dihydrogen phosphate esters of polyoxyethylene (6) decyl ether (as described in Example I).

A generic formula for a suitable ester of polyoxyalkylene glycol or a monoether thereof and a carboxylic acid follows:

$$Y-O-(RO)_n-\overset{\overset{O}{\|}}{C}-R'$$

wherein Y is R'', preferably hydrogen, or is characterized by the generic formula $$R''-\overset{\overset{O}{\|}}{C}-;$$

and R'', R', n and R are as previously defined.

Examples of suitable esters of polyoxyalkylene glycol and a carboxylic acid are polyoxyethylene glycol 400 distearate, polyoxyethylene glycol 200 monooleate, polyoxyethylene glycol 400 monococoate, polyoxyethylene glycol 600 monoisostearate; and polyoxypropylene glycol 1000 monolaurate. A preferred ester is a monolaurate of polyoxyethylene glycol having a molecular weight of about 600 (i.e., monolaurate of polyoxyethylene glycol 600).

Any suitable polyoxyalkylene glycol ethers may be utilized in the lubricating additive of the present invention. Ethers of polyoxyalkylene glycol and aliphatic alcohols or cycloaliphatic alcohols or alkyl-substituted aromatic alcohols are preferred. A generic formula of a suitable polyoxyalkylene glycol ether is as follows:

$$R'-O-(RO)_n-R''$$

where R, R', R'' and n are as previously defined, except that R' and R'' cannot both be hydrogen. Preferably R'' is hydrogen and R' is alkyl, cycloalkyl, aryl, or alkaryl.

Examples of suitable polyoxyalkylene glycol ethers are dodecyl phenol polyoxyethylene (7) ether; nonylphenol polyoxyethylene (8) ether; oleyl alcohol polyoxyethylene (10) ether; $C_{12-15}$ linear primary alcohol polyoxyethylene (6.5) ether; and $C_{11-15}$ secondary alcohol polyoxyethylene (5) ether. Preferred ethers are a lauryl polyoxyethylene ether with 23 oxyethylene repeat units and a stearyl polyoxyethylene ether with 20 oxyethylene repeat units.

Any suitable polyoxyalkylene glycol may be present in the above described esters and ethers. However, for both the polyoxyalkylene glycol esters and ethers, OR is preferably oxyethylene such that a polyoxyethylene glycol ester or ether is preferred.

Di-(2-hydroxyethyl)disulfide is available commercially from Phillips Chemical Company, Bartlesville, OK and Pennwalt Company, Philadelphia, PA. The disulfide may also be prepared as described in U.S. Pat. No. 4,250,046. Since the di-(2-hydroxyethyl)disulfide is commercially available or may be prepared by conventional methods and since such preparation does not play any part in the present invention, the preparation of di-(2-hydroxyethyl)disulfide will not be discussed more fully hereinafter.

As was the case with the di-(2-hydroxyethyl)disulfide, polyoxyalkylene glycol esters and polyoxyalkylene glycol ethers are also commercially available. Examples of commercially available polyoxyalkylene glycol esters are Kessco PEG 600 dilaurate and Kessco PEG 600 monostearate, available from Stepan Chemical, Maywood, N.J. Other examples of polyoxyalkylene glycol esters are Actrol 628 and Actrafos 110, available from Southland Corporation, Summit, IL. Examples of polyoxyalkylene glycol ethers are Tergitol 25-L-5 and Tergitol NP-7, available from Union Carbide Corporation, Danbury, CT.

Both the esters and ethers may also be prepared by conventional techniques. Examples of the preparation of polyoxyalkylene glycol esters are given in U.S. Pat. No. 3,004,056. Examples of the preparation of polyoxyalkylene glycol ethers are given in U.S. Pat. No. 2,213,477.

As was the case with di-(2-hydroxyethyl)disulfide, the preparation of either the polyoxyalkylene glycol esters for the polyoxyalkylene glycol ethers does not play a part in the present invention and will not be more fully described hereinafter.

The di-(2-hydroxyethyl)disulfide and the derivative of polyoxyalkylene glycol selected from the group consisting of polyoxyalkylene glycol esters and polyoxyalkylene glycol ethers may be combined in any suitable manner and under any suitable conditions. Preferably, the disulfide and derivative of polyoxyalkylene glycol are simply mixed together until a substantially clear, homogenous mixture is obtained. It is not believed that the conditions of mixing such as temperature or pressure have any effect on the forming of the mixture. Optionally, water can be present in the mixture.

Any suitable ratio of di-(2-hydroxyethyl)disulfide to the derivative of polyoxyalkylene glycol may be used in the lubricating additive mixture of the present invention. Preferably the ratio is such that the concentration of the disulfide in the mixture is in the range of about 5 weight percent to about 95 weight percent based on the weight of the mixture. More preferably, the concentration of the disulfide will be in the range of about 10 to about 50 weight percent based on the weight of the mixture.

The lubricating additive of the present invention may be utilized to improve the lubricating properties of any suitable water based fluid used in metalworking operations.

Any suitable amount of the lubricating additive may be added to the water based metalworking fluid. The amount added would generally be such as to result in a concentration of the lubricating additive in the water-based metalworking fluid in the range of about 0.01 weight percent to about 10 weight percent based on the weight of the combination of lubricating additive and water. More preferably, the concentration of the lubricating additive will be in the range of 0.02 weight percent to about 1 weight percent.

In addition to the lubricating additive of the present invention, the water-based metalworking fluid may contain other lubricating additives and other conventional additives such as rust preventatives, biocides and pH modifiers. However, since these other additives are well known and do not play a part in the present invention, such other additives are not more fully described hereinafter.

The following examples are presented in further illustration of the invention.

EXAMPLE I

In this example the preparation of a polyoxyethylene glycol phosphate ester is described. The preparation was carried out substantially in accordance with the procedure disclosed in U.S. Pat. No. 3,004,056. 42.2 grams of $C_{10}H_{21}O(C_2H_4O)_6H$ (polyoxyethylene (6) decyl ether; the reaction product of decyl alcohol and 6 equivalents of ethylene oxide; marketed as Chemal DA-6 by Chemax, Greenville, S.C.) were added to a 250 mL flask that had been flushed with nitrogen. Then, in three portions over a 5 minute period, 3.55 grams of phosphorus pentoxide (marketed by Aldrich Chemical Company, Milwaukee, Wis.) were added to the 250 mL flask. The resulting mixture was heated from about 40° C. to about 90° C., kept at the latter temperature for about one hour, and was then cooled. After 43.2 grams of the product (most likely a mixture of mono and dihydrogen phosphate ethers of polyoxyethylene (6) decyl ether were recovered. The product was water-soluble. It is labeled PEG-Ester A.

EXAMPLE II

This example illustrates the use of PEG Ester A, in combination with di-(2-hydroxyethyl)disulfide ($HO—C_2H_5—S—S—C_2H_5—OH$; also called diethanol disulfide or dithiodiglycol; marketed by Phillips Chemical Company, Bartlesville, OK), as a lubricating additive in aqueous solutions. Several aqueous solutions were tested in a Four-Ball EP (extreme pressure) test in accordance with ASTM D-2783. Test data are summarized in Table I.

TABLE I

| Run | Solution | Fail Load[1] (Kg) |
|---|---|---|
| 1 (Control) | 1 wt % Dithiodiglycol[2] | 126 |
| 2 (Control) | 2 wt % Dithiodiglycol | 126 |
| 3 (Control) | 1 wt % PEG-Ester A | 126 |
| 4 (Control) | 2 wt % PEG-Ester A | 126 |
| 5 (Invention) | 1 wt % Dithiodiglycol + 1 wt % PEG-Ester A | 160 |
| 6 (Control) | 2 wt % PEG[3] | 126 |
| 7 (Control) | 1 wt % Dithiodiglycol + 1 wt % PEG | 126 |

[1]the load at which the movable steel ball "welds" onto one or more of the stationary steel balls and rotation of the first ball ceases

[2]also called di-(2-hydroxyethyl) disulfide or diethanol disulfide

[3]polyoxyethylene glycol having a molecular weight of about 600, marketed by Aldrich Chemical Company.

Test data in Table I show that an aqueous mixture of dithiodiglycol and PEG-Ester A exhibits better lubricity than either component alone (compare runs 2, 4 and 5). This effect is especially surprising in view of the fact that an aqueous mixture of dithiodiglycol and underivatized polyoxyethylene glycol did not exhibit a synergistic effect.

EXAMPLE III

This example illustrates the use of another polyoxyethylene glycol ester, in combination with di-(2-hydroxyethyl)disulfide as a water soluble lubricating agent. The polyoxyethylene glycol ester employed was PEG 600 monolaurate (marketed by Stepan Chemical, Maywood, N.J.). This ester is labeled PEG-Ester B. Results of Four-Ball EP tests (ASTM D-2783) are summarized in Table II.

TABLE II

| Run | Solution | Fail Load (Kg) |
|---|---|---|
| 2 (Control) | 2 wt % Dithiodiglycol | 126 |
| 8 (Control) | 2 wt % PEG-Ester B | 126 |
| 9 (Invention) | 1 wt % Dithiodiglycol + 1 wt % PEG-Ester B | 160 |

Data in Table II show that the aqueous mixture of di-(2-hydroxyethyl)disulfide and polyoxyethylene monolaurate is a more effective lubricant than aqueous solutions of either component alone.

Falex EP (extreme pressure) and wear tests in accordance with ASTM D-3233 and ASTM D-2670, respectively, were carried out employing aqueous solutions containing 1 weight-% di-(2-hydroxyethyl)disulfide and 1 weight-% PEG-Ester B. Results of Run 10 (Falex wear) were: cumulative teeth wear of 23; an average torque of 34 inch-lb (both determined at a constant load of 2000 lb and a run time of 15 minutes). Results of Run 11 (Falex EP) were: fail load of 3250 lb and a final torque of 39 inch-lb (final torque is the torque at a load 250 lb less than the fail load). These lubricity data confirm that the above-described mixture is an effective EP lubricant (water alone would fail during the break-in period at a load of 300 lb or less).

EXAMPLE IV

This example illustrates the use of a mixture of polyoxyethylene glycol ethers and di-(2-hydroxyethyl)disulfide. The first PEG ether employed, labeled PEG-Ether A, was polyoxyethylene (23) lauryl ether (marketed as Brij 35 by ICI Americas, Wilmington, Del.). The second PEG ether (labeled PEG-Ether B) was polyoxyethylene (20) stearyl ether (marketed as Brij 78 by ICI Americas). Falex EP test data are summarized in Table III.

TABLE III

| Run | Solution | Fail Load (lb) | Final Torque[1] (inch-lb) |
|---|---|---|---|
| 12 (Control) | 1.6 wt % Dithiodiglycol | 1750 | 112 |
| 13 (Control) | 1.6 wt % PEG-Ether A | 500 | 32[2] |
| 14 (Invention) | 0.8 wt % Dithiodiglycol + 0.8 wt % PEG-Ether A | 3500 | 77 |
| 15 (Control) | 1.6 wt % PEG-Ether B | 750 | 48 |
| 16 (Invention) | 0.8 wt % Dithiodiglycol + 08 wt % PEG-Ether B | 3000 | 67 |

[1]Torque at a load of 250 lb below the fail load
[2]Torque at break-in load (300 lb.)

Data in Table III show that aqueous mixtures of a polyoxyethylene glycol ether and di-(2-hydroxyethyl)disulfide exhibited superior EP lubricity vs. aqueous solutions containing only one component.

EXAMPLE V

This example illustrates the use of two more polyoxyethylene glycol esters, in combination with di-(2-hydroxyethyl)disulfide, as lubricity agents. One of the tested esters, labeled PEG-Ester C, is Inversol 170 (marketed by Keil Chemical, Hammon, Ind.). NMR and IR spectroscopic data indicated that PEG-Ester C is an ester of PEG and a long-chain (about 17C) carboxylic acid. Another ester, labeled PEG-Ester D, is EM 705 (marketed by Keil Chemical) which, according to elemental analysis, NMR and IR spectroscopic data, most probably is a phosphate ester of a PEG derivative of an aliphatic alcohol.

. Four-Ball EP test results on aqueous solutions are summarized in Table IV and essentially confirm earlier-reported data on other PEG esters (see Tables I and II).

TABLE IV

| Run | Solution | Fail Load (lb) |
|---|---|---|
| 2 (Control) | 2 wt % Dithiodiglycol | 126 |
| 17 (Control) | 2 wt % PEG-Ester C | 160 |
| 18 (Invention) | 1 wt % Dithiodiglycol + 1 wt % PEG-Ester C | 250 |
| 19 (Control) | 2 wt % PEG-Ester D | 126 |
| 20 (Invention) | 1 wt % Dithiodiglycol + 1 wt % PEG-Ester D | 200 |

Falex EP and wear test results employing aqueous solutions of dithiodiglycol and PEG-Esters C and D are summarized in Tables V and VI.

TABLE V

| Run | Solution | Fail load (lb) | Final Torque (inch-lb) |
|---|---|---|---|
| 12 (Control) | 1.6 wt % Dithiodiglycol | 1750 | 112 |
| 21 (Control) | 1.6 wt % PEG-Ester C | 3250 | 69 |
| 22 (Invention) | 0.8 wt % Dithiodiglycol + 0.8 wt % PEG Ester C | 3500 | 39 |
| 23 (Invention) | 0.8 wt % Dithiodiglycol + 0.8 wt % PEG-Ester D | 3750 | 46 |
| 24 (Control) | 0.8 wt % Dithiodiglycol + 0.8 wt % PEG[1] | 750 | 43 |

[1]See footnote 3 of Table I.

TABLE VI

| Run | Solution | Accumulative Teeth Wear[1] | Average Torque[1] (inch-lb) |
|---|---|---|---|
| 12 (Control) | 1.6 wt % Dithiodiglycol | —[2] | —[2] |
| 25 (Control) | 1.6 wt % PEG-Ester C | 226 | 53 |
| 26 (Invention) | 0.8 wt % Dithiodiglycol + 0.8 wt-% PEG-Ester C | 93 | 43 |
| 27 (Control) | 1.6 wt % PEG-Ester D | 34 | 42 |
| 28 (Invention) | 0.8 wt % Dithiodiglycol + 0.8 wt % PEG-Ester D | 22 | 35 |
| 29 (Control) | 0.8 wt % Dithiodiglycol + 0.8 wt % PEG[3] | 83 | 93 |

[1]during test run of 15 minutes
[2]failed after 1 minute
[3]see footnote 3 of Table I.

Data in Tables V and VI clearly show the advantages of mixtures of di-(2-hydroxyethyl)disulfide and either PEG-Ester C or D versus aqueous solutions of the single components. In addition, the invention mixtures also exhibited lubricity advantages (higher fail loads, less teeth wear and lower torque) versus mixtures of dithiodiglycol and underivatized polyoxyethylene glycol (runs 24, 29).

EXAMPLE VI

In this example metalworking fluids containing common ingredients such as a rust inhibitor, a biocide and an amine (for pH adjustment) are described. Compositions of these solutions are summarized in Recipe I.

| | Recipe I | | | |
|---|---|---|---|---|
| Ingredients | Run 30 (Control) | Run 31 (Invention) | Run 32 (Control) | Run 33 (Invention) |
| PEG-Ester C (wt %) | 0.8 | 0.8 | — | — |
| PEG-Ester D (wt %) | — | — | 0.8 | 0.8 |
| Dithiodiglycol (wt %) | — | 0.8 | — | 0.8 |
| Triethanolamine (wt %) | 0.8 | 0.8 | 0.8 | 0.8 |
| Synkad 500[1] (wt %) | 0.3 | 0.3 | 0.3 | 0.3 |
| Bioban P-1487[2] (wt %) | 0.05 | 0.05 | 0.05 | 0.05 |
| Water | balance | balance | balance | balance |

[1]carboxylic acid salt rust inhibitor, marketed by Keil Chemical.
[2]a biocide marketed by Keil Chemical.
Note:
all solutions were prepared by first preparing a concentrated solution and diluting 1 part by volume of the concentrated solution with 9 parts by volume of water.

Falex EP test results are summarized in Table VII.

TABLE VII

| Run | | Fail Load (lb) | Final Torque (inch-lb) |
|---|---|---|---|
| Run 30 | (Control) | 2750 | 54 |
| Run 31 | (Invention) | 3250 | 48 |
| Run 32 | (Control) | 2750 | 47 |
| Run 33 | (Invention) | 3500 | 56 |

Data in Table VII are in good agreement with those of Table V employing various solutions also containing dithiodiglycol and/or PEG-Esters C and D, but without the amine, rust inhibitor and biocide.

Reasonable variations and modifications are possible within the scope of the disclosure and the appended claims to the invention.

That which is claimed is:

1. A method for improving the lubricating properties of a water based fluid used in metalworking operations comprising the step of adding a mixture of di-(2-hydroxyethyl)disulfide and a derivative of polyoxyalkylene glycol selected from the group consisting of polyoxyalkylene glycol esters and polyoxyalkylene glycol ethers to said water-based fluid used in metalworking operations.

2. A method in accordance with claim 1 wherein said polyoxyalkylene glycol ester is an ester of a polyoxyalkylene glycol or a monoether thereof and a phosphorus containing acid.

3. A method in accordance with claim 2 wherein said phosphorous containing acid is phosphoric acid.

4. A method in accordance with claim 3 wherein said polyoxyalkylene glycol ester is a mixture of mono and di-hydrogen phosphate esters of polyoxyethylene (6) decyl ether.

5. A method in accordance with claim 1 wherein said polyoxyalkylene glycol ester is an ester of polyoxyalkylene glycol or a monoether thereof and a carboxylic acid.

6. A method in accordance with claim 5 wherein said polyoxyalkylene glycol ester is an ester of polyoxyalkylene glycol and an aliphatic carboxylic acid.

7. A method in accordance with claim 6 wherein said polyoxyalkylene glycol ester is a monolaurate of polyoxyethylene glycol having a molecular weight of about 600.

8. A method in accordance with claim 1 wherein said polyoxyalkylene glycol ether is an ether of polyoxyalkylene glycol and an alcohol selected from the group consisting of aliphatic alcohols, cycloaliphatic alcohols and alkyl-substituted aromatic alcohols.

9. A method in accordance with claim 8 wherein said polyoxyalkylene glycol ether is lauryl polyoxyethylene ether with 23 oxyethylene repeat units.

10. A method in accordance with claim 8 wherein said polyoxyalkylene glycol ether is stearyl polyoxyethylene ether with 20 oxyethylene repeat units.

11. A method in accordance with claim 1 wherein the concentration of di-(2-hydroxyethyl)disulfide in said mixture is in the range of about 5 weight-% to about 95 weight-% based on the weight of said mixture.

12. A method in accordance with claim 1 wherein the concentration of di-(2-hydroxyethyl)disulfide in said mixture is in the range of about 10 weight-% to about 50 weight-% based on the weight of said mixture.

13. A method in accordance with claim 1 wherein a sufficient amount of said mixture is added to said water-based fluid to result in a concentration of said mixture in said water-based fluid in the range of about 0.01 weight-% to about 10 weight-% based on the weight of the combination of said mixture and said water based fluid.

14. A method in accordance with claim 1 wherein a sufficient amount of said mixture is added to said water-based fluid to result in a concentration of said mixture in said water-based fluid in the range of about 0.02 weight-% to about 1 weight-% based on the weight of the combination of said mixture and said water-based fluid.

15. A method for producing a lubricating additive comprising the step of mixing di-(2-hydroxyethyl)disulfide and a derivative of polyoxyalkylene glycol selected from the group consisting of polyoxyalkylene glycol esters and polyoxyalkylene glycol ethers to produce said lubricating additive.

16. A method in accordance with claim 15 wherein said polyoxyalkylene glycol ester is an ester of a polyoxyalkylene glycol or a monoether thereof and a phosphorus containing acid.

17. A method in accordance with claim 15 wherein said phosphorous containing acid is phosphoric acid.

18. A method in accordance with claim 17 wherein said polyoxyalkylene glycol ester is a mixture of mono and di-hydrogen phosphate esters of polyoxyethylene (6) decyl ether.

19. A method in accordance with claim 15 wherein said polyoxyalkylene glycol ester is an ester of polyoxyalkylene glycol or a monoether thereof and a carboxylic acid.

20. A method in accordance with claim 19 wherein said polyoxyalkylene glycol ester is an ester of polyoxyalkylene glycol and an aliphatic carboxylic acid.

21. A method in accordance with claim 20 wherein said polyoxyalkylene glycol ester is a monolaurate of polyoxyethylene glycol having a molecular weight of about 600.

22. A method in accordance with claim 15 wherein said polyoxyalkylene glycol ether is an ether of polyoxyalkylene glycol and an alcohol selected from the group consisting of aliphatic alcohols, cycloaliphatic alcohols, and alkyl-substituted aromatic alcohols.

23. A method in accordance with claim 22 wherein said polyoxyalkylene glycol ether is lauryl polyoxyethylene ether with 23 oxyethylene repeat units.

24. A method in accordance with claim 22 wherein said polyoxyalkylene glycol ether is stearyl polyoxyethylene ether with 20 oxyethylene repeat units.

25. A method in accordance with claim 15 wherein the concentration of di-(2-hydroxyethyl)disulfide in said mixture is in the range of about 5 weight-% to about 95 weight-% based on the weight of said mixture.

26. A method in accordance with claim 15 wherein the concentration of di-(2-hydroxyethyl)disulfide in said mixture is in the range of about 10 weight-% to about 50 weight-% based on the weight of said mixture.

27. A composition comprising a mixture of di-(2-hydroxyethyl)disulfide and a derivative of polyoxyalkylene glycol selected from the group consisting of polyoxyalkylene glycol esters and polyoxyalkylene glycol ethers.

28. A composition in accordance with claim 27 wherein said polyoxyalkylene glycol ester is an ester of polyoxyalkylene glycol or a monoether thereof and a phosphorus containing acid.

29. A composition in accordance with claim 28 wherein said phosphorus containing acid is phosphoric acid.

30. A composition in accordance with claim 29 wherein said polyoxyalkylene glycol ester is a mixture of mono and di-hydrogen phosphate esters of polyoxyethylene (6) decyl ether.

31. A composition in accordance with claim 27 wherein said polyoxyalkylene glycol ester is an ester of polyoxyalkylene glycol or a monoether thereof and a carboxylic acid.

32. A composition in accordance with claim 31 wherein said polyoxyalkylene glycol ester is a monolaurate of polyoxyethylene glycol having a molecular weight of about 600.

33. A composition in accordance with claim 27 wherein said polyoxyalkylene glycol ether is an ether of polyoxyalkylene glycol and an alcohol selected from the group consisting of aliphatic alcohols, cycloaliphatic alcohols and alkyl-substituted aromatic alcohols.

34. A composition in accordance with claim 33 wherein said polyoxyalkylene glycol ether is lauryl polyoxyethylene ether with 23 oxyethylene repeat units.

35. A composition in accordance with claim 33 wherein said polyoxyalkylene glycol ether is stearyl polyoxyethylene ether with 20 oxyethylene repeat units.

36. A composition in accordance with claim 27 wherein the concentration of di-(2-hydroxyethyl)disulfide in said mixture is in the range of about 5 weight-% to about 95 weight-% based on the weight of said mixture.

37. A composition in accordance with claim 27 wherein the concentration of di-(2-hydroxyethyl)disulfide in said mixture is in the range of about 10 weight-% to about 50 weight-% based on the weight of said mixture.

38. A composition in accordance with claim 31 wherein said polyoxyalkylene glycol ester is an ester of polyoxyalkylene glycol and an aliphatic carboxylic acid.

* * * * *